United States Patent [19]

Bergstrom

[11] Patent Number: 4,703,638

[45] Date of Patent: Nov. 3, 1987

[54] REMOVABLE CORE LOCKSET WITH ANTI-PICK CORE REMOVAL RING

[76] Inventor: Roger E. Bergstrom, 3715 Pine Grove Rd., Charlotte, N.C. 28212

[21] Appl. No.: 900,187

[22] Filed: Aug. 25, 1986

[51] Int. Cl.[4] ..... E05B 27/04

[52] U.S. Cl. ..... 70/369 R; 70/419; 70/367; 70/379

[58] Field of Search ..... 70/369, 370, 416, 419, 70/367, 368, 379, 380

[56] References Cited

U.S. PATENT DOCUMENTS

| | | | |
|---|---|---|---|
| 1,389,380 | 8/1921 | Raab | 70/454 X |
| 1,487,900 | 3/1924 | Teich | 70/367 |
| 1,905,902 | 4/1933 | Jacobi | 70/369 |
| 1,913,963 | 6/1933 | Shinn | 70/368 |
| 1,986,453 | 1/1935 | Shaw | 70/367 X |
| 2,019,534 | 11/1935 | Henst | 70/368 X |
| 2,049,742 | 8/1936 | Lowe | 70/369 X |
| 3,324,693 | 6/1967 | Check | 70/369 |
| 3,429,154 | 2/1969 | Schwartz | 70/367 X |
| 3,526,111 | 9/1970 | Jacobi | 70/368 |
| 3,863,475 | 2/1975 | Foss | 70/370 X |
| 4,191,037 | 3/1980 | Patriquin | 70/369 |
| 4,484,462 | 11/1984 | Berkowitz | 70/368 |

*Primary Examiner*—Robert L. Wolfe
*Assistant Examiner*—Suzanne L. Dino
*Attorney, Agent, or Firm*—W. Thad Adams, III

[57] ABSTRACT

A removable core (15) for a lockset (10) has a core removal ring (35') which is provided with a gap therein which prevents the lock from being picked by turning the core removal ring with an elongate wire having a wedge-shaped end. One of the end edges of the core removal ring (35') defining the gap is positioned in substantial registration with a keyway (18) at an approximate 6 o'clock position. The other end edge of core removal ring (35') normally resides at an approximate 3 o'clock position.

3 Claims, 7 Drawing Figures

REMOVABLE CORE LOCKSET WITH ANTI-PICK CORE REMOVAL RING

TECHNICAL FIELD AND BACKGROUND OF THE INVENTION

This invention relates to a removable core lockset provided with an anti-pick core removal ring. The lockset of the type to which this application relates is a key lockset which may be used in many different applications. One particularly useful application of a lockset such as that described in this application is in office, commercial and industrial environments where it is necessary from time to time to rekey a lockset so that a prior tenant or occupant cannot gain further access to an enclosed area. Conventional locksets require that the entire lockset be removed, at least partially disassembled, and rekeyed by a skilled technician. Once it has been determined that it has properly rekeyed and that the desired keys unlock the lock, it is reinstalled for use.

This procedure is relatively expensive, time consuming and requires the ready availability of skilled labor.

Recently, a new type of lockset has been introduced which includes a removable core. The core, containing the keyway is accessed in a conventional manner by a conventional key. When a properly coded key is inserted and turned in the proper direction, a cylinder cam on the rear of the lock housing is actuated, opening the door latch or other locked structure. The core is locked into the lock housing of the lockset by a spring-loaded core locking pin.

When desired, the key coding of the lockset can be easily changed. A special key, somewhat longer than the regular access key, is inserted into the keyway and urges upwardly a separate release pin which locks a core removal ring to the core. By turning the key slightly, the core removal ring engages against the spring-loaded core locking pin and retracts it from its position in the lock housing. Then, the key is pulled and the core, still on the key, slides out of the lock housing. A new core having new key coding is inserted into the lock housing and locked into place. This process takes only a few seconds is therefore much more cost effective and reliable than prior methods.

However, it has been determined that at least some of the removable core locksets of the type described above are easily picked by inserting a thin wire having a predetermined shape completely into and through a keyway into alignment with the core removal ring, the pick can be twisted and the core removal ring turned enough to cause the core locking pin to be retracted from its position in the lock housing. Of course, this is a clear breach of security since once the core is removed, it is a simple matter to rotate the cylinder cam through the now-empty lock housing.

Accordingly, a removable core lockset has been devised with an anti-pick core removal ring. The anti-pick core removal ring can be easily retrofitted onto existing cores.

SUMMARY OF THE INVENTION

Therefore, it is an object of the invention to provide a removal core lockset with an anti-pick core removal ring in order to provide greater security to the lock.

It is another object of the invention to provide an anti-pick core removal ring for a removable core lockset which can be easily retrofitted into existing cores.

It is another object of the invention to provide a removable core lockset with an anti-pick core removal ring which does not interfere with regular key operation of the lock or with removal of the core when changing the key combination is desired.

These and other objects and advantages of the present invention are achieved by providing a removable core lockset which includes a lock housing and a core locked into the lock housing. The core has a plurality of bottom pins and driver pins cooperating with a keyway to unlock the lockset when a properly coded key is inserted therein and turned. The core also has a release pin operable by a longer than normal key to rotate a core removal ring mounted on the core to unlock the core from the lockset and permit removal of the core and replacement of another core into the lockset to thereby change the key coding of the lockset.

In combination with the above-described removal core lockset is provided anti-pick means cooperating with the core removal ring to prevent rotation of the core removal ring by a wire-like pick inserted into the keyway past the plurality of bottom and drive pins and into twisting engagement with the core removal ring sufficient to unlock the core from the lock housing.

Preferably, the anti-pick means comprises the core removal ring having a gap therein in registration with the keyway and extending circumferentially away from the keyway in the direction in which the core removal ring is turned for unlocking it from the lock housing. The gap prevents rotational engagement between a pick and the core removal ring.

Preferably, the gap in the core removal ring has an arc of approximately 90° and the opposite end edges of the core removal ring defining the gap are tapered to cause a pick to ride over the ring rather than engaging the opposite end edges of the core removal ring defining the gap.

BRIEF DESCRIPTION OF THE DRAWINGS

These and other objects and advantages of the removable core lockset will be further described below when taken in conjunction with the following drawings, in which.

DETAILED DESCRIPTION OF THE PREFERRED EMBODIMENT

Figure 1:
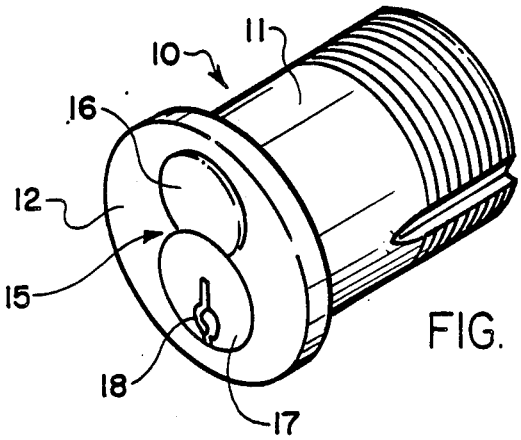
FIG. 1 is a perspective view of a mortise-type lockset according to the present invention.
Figure 2:
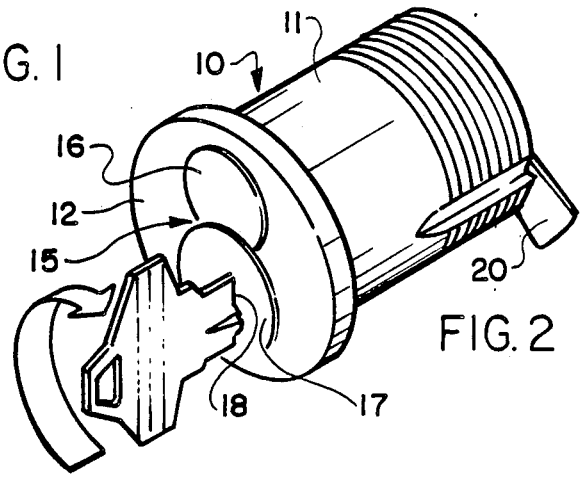
FIG. 2 is a perspective view similar to that in FIG. 1 but showing insertion and rotation of the key therein to unlock the lockset.
Figure 3:
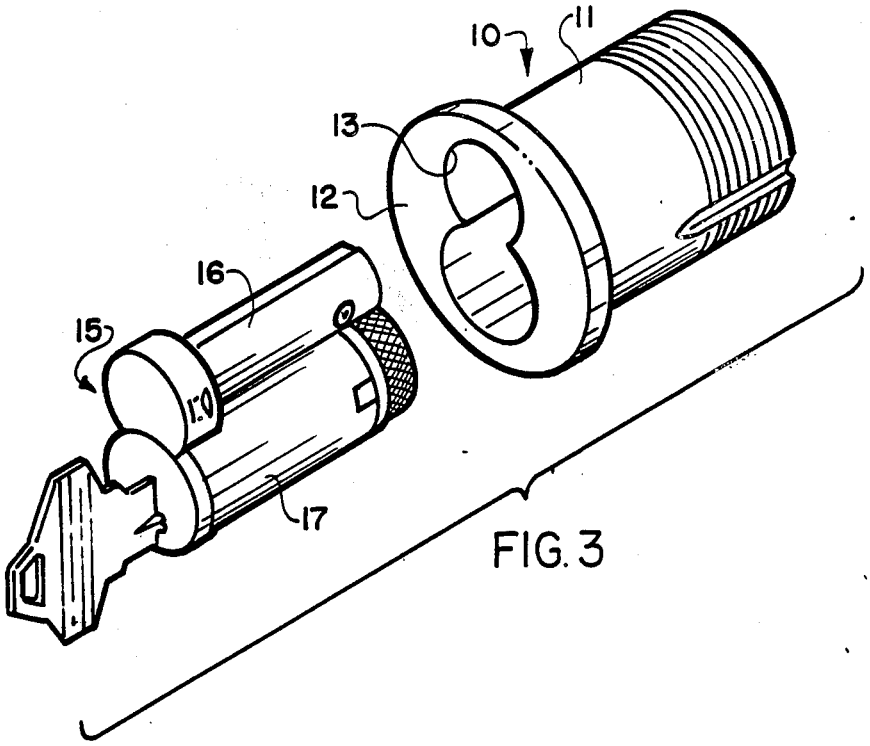
FIG. 3 is a perspective view similar to FIGS. 1 and 2, but showing removal of the core from the lock housing.

Referring now specifically to FIGS. 1, 2 and 3 of the drawings, a mortise-type lock according to the present invention is shown and illustrated. Since the improvement to the lock which comprises the invention is completely internal, the exterior, physical appearance, as is shown in FIGS. 1, 2 and 3 is identical.

A lock of this type comprises a lockset broadly designated at reference 10. The lockset 10 includes a lock housing 11 with an enlarged face 12. Lock housing 11 and face 12 are each formed of tool steel. The interior walls of lock housing 11 define a figure-eight shaped bore 13 (see FIG. 3) into which is positioned a removable core 15. Core 15 comprises two substantially cylindrical cylinders 16 and 17 which are joined together along their respective lengths. Cylinder 17 includes a keyway 18 which communicates with the face 12 and extends completely through cylinder 17 from one end to the other.

Referring now to FIG. 2, a key is inserted in keyway 18 and turned. If the key is properly coded for lockset 10, cylinder 17 is permitted to turn, rotating a cylinder cam 20. The cylinder cam operates a door latch or other structure which is normally locked.

The removable core feature of the lockset 10 is illustrated in FIG. 3. By inserting a special key which is somewhat longer than the normal key, core 15 is easily removed from lock housing 11. Another core 15 is easily and quickly insertable into lock housing 11 thereby establishing a different key coding for lockset 10.

Figure 4:
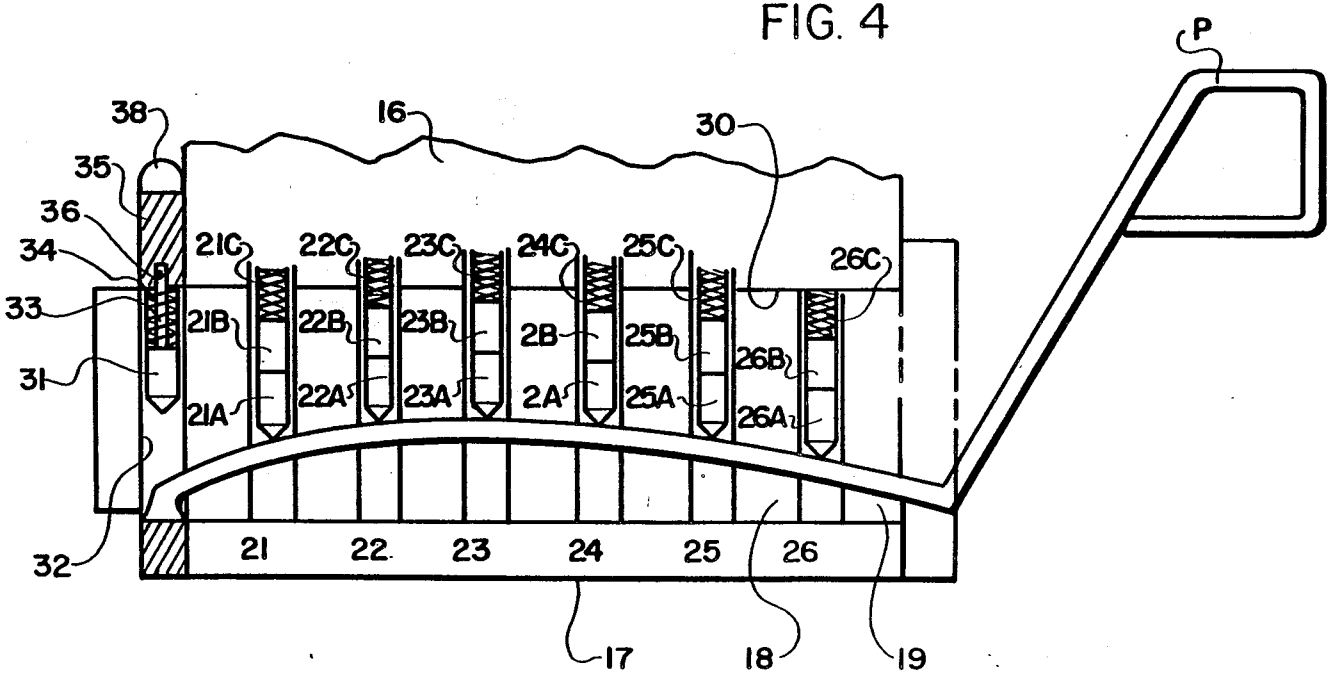
FIG. 4 is a fragmentary schematic view showing a pick of the type which can be used to pick a prior art removable core lockset.

Referring now to FIG. 4, a schematic view of cylinder 17 is shown. The interior of cylinder 17 includes a cylindrical housing 19 which is provided with six perpendicularly disposed cylinder and pin assemblies 21 through 26, inclusive. Cylinder assemblies 21 through 26 include, respectively, bottom pins 21*a* through 26*a*, driver pins 21*b* through 26*b* and springs 21*c* through 26*c*. The respective lengths of the bottom pins 21*a* through 26*a* and driver pins 21*b* and 26*b*, in relation to the coding of a key permits the lock to be locked and opened only when accessed with a properly coded key so that a shear line 30 is defined by the fit of the pin assemblies in housing 19. Note that bottom pins 21*a* through 26*a* and driver pins 21*b* through 26*b* reside in their respective cylinders 21 through 26 in direct contact with each other. Only if through the use of a properly coded key each of these pins are moved upwardly to the exact point where the bottom of each driver pin 21*b* through 26*b* and the upper end of respective bottom pins 21*a* through 26*a* reside directly at the shear line 30 will the lock open. This is conventional to all locks of this general type and does not in and of itself comprise the invention.

In the removable core lockset 10 disclosed herein, the core 15 is retained within lock housing 11 by means of a release pin 31 which is contained within its own cylinder 32 defined by the end of cylinder 17 remote from face 12. Pin 31 includes a slender stem 33 on its upper end, around which is positioned a spring 34. Pin 31 is positioned in radial alignment with a core removal ring 35 (shown in cross-section in FIG. 4). When a special key is inserted in keyway 18 and into engagement with the bottom of release pin 31, pin 32 and stem 33 are urged upwardly against the downward bias of spring 34 into an annular bore 36 in the inner axial surface of core removal ring 35. Once stem 33 is positioned in bore 36, the cylinder 17 and the core removal ring 35 are locked together for unison rotation. Then, a short turn of the key releases the core 15 and permits it to be removed from lock housing 11.

Figure 5:
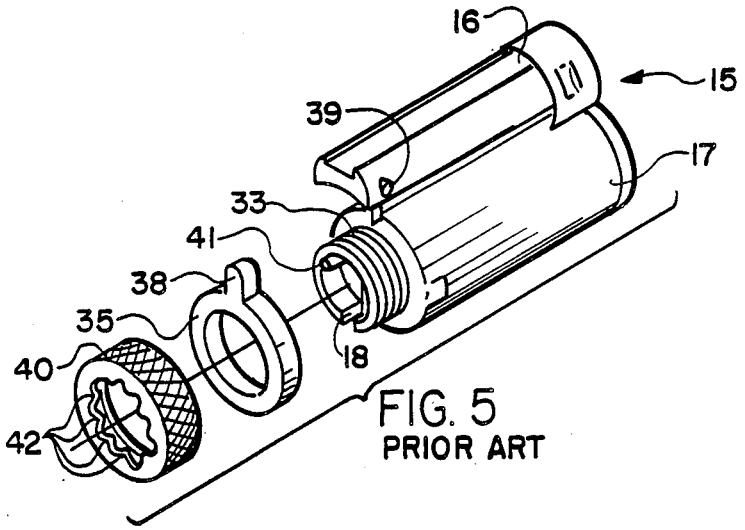
FIG. 5 PRIOR ART
FIG. 5 is a partially exploded view of the core of a prior art lockset.

The prior art method by which this is done is shown more specifically in FIG. 5. As is shown, core removal ring 35 has an elongate actuator 38 projecting radially outwardly from its outer peripheral surface. The turning of the key rotates core removal ring 35 slightly counterclockwise, causing a core locking pin 39 to be retracted into cylinder 16. Normally, pin 39 is urged outwardly by a spring (not shown) into a bore (not shown) in the inner walls of lock housing 11 defining bore 13. Once pin 39 is retracted, the core 15 is easily removed.

By continued reference to FIG. 5, core removal ring is maintained on the end of cylinder 17 by means of a cylinder plug retainer 40. Normally, cylinder plug retainer 40 is locked into position on cylinder 17 by means of a retainer pin 41 which resides in one of a plurality semicircular grooves 42 formed in the outer face of cylinder plug retainer 40.

The construction illustrated in FIG. 5 is relatively easy to pick, meaning that the core 15 can be removed from lock housing 11 without a properly coded key.

This is accomplished as is illustrated in FIG. 4. A pick "P" formed of a relatively stiff wire is bent into the shape shown in FIG. 4. A handle (shown on the right outside the lock) enables the pick to be introduced into keyway 18. The pick includes a long curved stem which permits bottom pins 21*a* through 26*a* to easily ride over it as it proceeds down the keyway. Once the pick reaches the portion of the keyway in radial assignment with core removal ring 35, it is twisted. The tip of the pick is formed into a wedge shape which quickly wedges itself into the close tolerance between core removal ring 35 and the adjacent surface of cylinder 17. Once the wedging has taken place, cylinder 17 and core removal ring rotate in unison, just as of stem 33 were positioned in bore 36. Rotation of core removal ring 35 moves the actuator 38 counterclockwise, retracting core locking pin 39 from its bore in the lock housing 11. Then the core 15 is removed just as if it had been actuated with a key.

Figure 6:
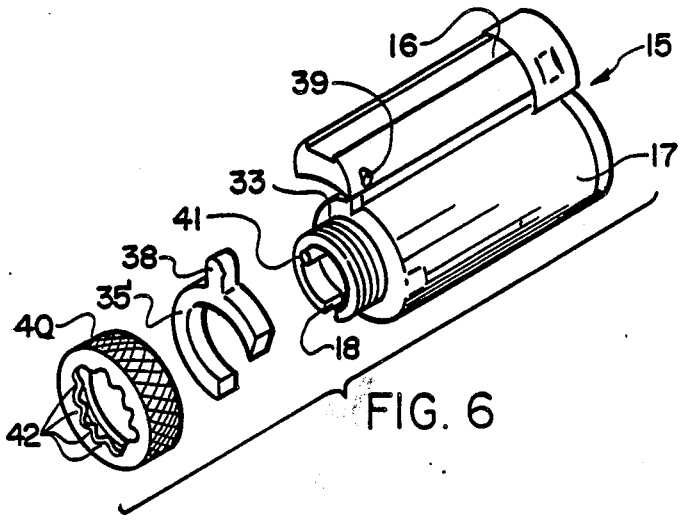
FIG. 6 is a partially exploded perspective view of a core according to the present invention.

Referring now to FIG. 6, a core removal ring 35' according to the present invention is substituted for the core removal ring 35 in FIG. 5. As is shown, a segment has been cut from core removal ring 35' to define a gap of approximately 90° defined by the opposite end edge portions of the remaining core removal ring 35'. One of the end edges of core removal ring 35' is positioned in substantial registration with keyway 18 at an approximate 6 o'clock position. The other end edge of core removal ring 35' normally resides at an approximate 3 o'clock position. Note also that the end edges of core removal ring 35' are tapered so that even if some type of extremely thin pick could be inserted along shear line 30 into the area of core removal ring 35', any such device would ride up over the taper rather than engaging against it.

Figure 7:
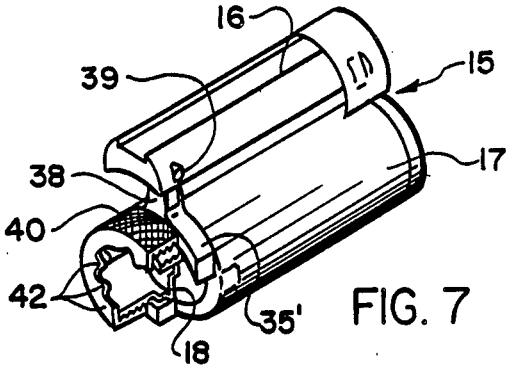
FIG. 7 is a perspective view, with parts broken away, of an assembled core according to the present invention.

The assembled core 15 is shown in FIG. 7. Not only is the invention according to this application simple but can be easily retrofitted onto existing removable core locks at minimal expense.

A removable core lockset which includes anti-pick means is described above. Various details of the invention may be changed without departing from its scope. Furthermore, the foregoing description of the preferred embodiment according to the present invention is provided for the purpose of illustration only and not for the purpose of limitation-the invention being defined by the claims.

I claim:

1. In a removable core lockset which includes a lock housing and a core locked into said lock housing, the core having a plurality of bottom pins and driver pins cooperating with a keyway therein to unlock the lockset when a properly coded key is inserted and turned therein, the core also having a release pin operable by a longer than normal key to rotate a core removal ring mounted on the core to unlock the core from the lockset and permit removal of the core and placement of another core into the lockset to thereby change the key coding of the lockset, the combination therewith of anti-pick means cooperating with the core removal ring to prevent rotation of the core removal ring by a wire-like pick inserted into the keyway past the plurality of pins and into twisting engagement with the core removal ring, wherein said anti-pick means comprises the core removal ring having a gap therein in registration with the keyway and extending circumferentially away from the keyway in the direction the core removal ring is turned for unlocking the core removal ring from the lock housing, said gap preventing engagement between a pick and the core removal ring sufficient to rotate the core removal ring and thereby release it from the lockset.

2. In a removable core lockset according to claim 1, wherein said gap comprises approximately 90° of arc.

3. In a removable core lockset according to claim 1, wherein the opposing end edges of the core removal ring defining the gap are tapered from the inner periphery to the outer periphery thereof to cause a pick to ride over either end edge of the core removal ring rather than engaging against and rotating it.

* * * * *